US008145109B2

(12) United States Patent
Ishikawa

(10) Patent No.: US 8,145,109 B2
(45) Date of Patent: Mar. 27, 2012

(54) SHEET SEPARATOR AND FIXING UNIT USING THE SAME AND IMAGE FORMING APPARATUS INCORPORATING THE FIXING UNIT

(75) Inventor: Chuuji Ishikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 12/385,785

(22) Filed: Apr. 20, 2009

(65) Prior Publication Data

US 2009/0274492 A1 Nov. 5, 2009

(30) Foreign Application Priority Data

Apr. 30, 2008 (JP) ..... 2008-118735

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS

| | | | | |
|---|---|---|---|---|
| 3,955,813 | A | 5/1976 | Edwards | |
| 4,257,054 | A | 3/1981 | Ishikawa | |
| 6,595,907 | B1 | 7/2003 | Ishikawa et al. | |
| 7,040,806 | B2 | 5/2006 | Ishikawa et al. | |
| 2004/0067080 | A1 * | 4/2004 | Berg et al. | 399/323 |

FOREIGN PATENT DOCUMENTS

| | | |
|---|---|---|
| JP | 57-46794 | 10/1982 |
| JP | 2876217 | 1/1999 |
| JP | 11-334191 | 12/1999 |
| JP | 2005-157179 | 6/2005 |
| JP | 2007-178732 | 7/2007 |
| JP | 2007-187715 | 7/2007 |
| JP | 2007-187791 | 7/2007 |
| JP | 2007-199462 | 8/2007 |
| JP | 2007-206153 | 8/2007 |
| JP | 2007-212922 | 8/2007 |
| JP | 2007-225846 | 9/2007 |
| JP | 2007-233228 | 9/2007 |
| JP | 2007-240920 | 9/2007 |
| JP | 2007-240921 | 9/2007 |
| JP | 2007-248679 | 9/2007 |
| JP | 2008-003277 | 1/2008 |

OTHER PUBLICATIONS

An English language abstract of Japanese Publication No. JP 3-32878, published Feb. 13, 1991.

* cited by examiner

*Primary Examiner* — Quana M Grainger
(74) *Attorney, Agent, or Firm* — Harness, Dickey & Pierce, P.L.C.

(57) ABSTRACT

A sheet separator using air includes a plurality of nozzles and a guide member. The plurality of nozzles, through which compressed air is ejected against a nip portion where a plurality of rotating members meets, presses each other, and carries a sheet of a recording medium therebetween, is disposed downstream in a direction of sheet transport and also in a direction of a width of the recording medium. The guide member holds and secures the nozzles, and includes a conduit to supply the compressed air to the nozzles, and a guide surface to direct the recording medium separated from the nip portion. A tip of each of the nozzles from which air is ejected projects beyond the leading edge of the guide member on the nip portion side. A fixing unit includes the sheet separator. An image forming apparatus includes the sheet separator.

9 Claims, 13 Drawing Sheets

SHEET SEPARATOR AND FIXING UNIT USING THE SAME AND IMAGE FORMING APPARATUS INCORPORATING THE FIXING UNIT

CROSS-REFERENCE TO RELATED APPLICATIONS

This patent application is based on and claims priority pursuant to 35 U.S.C. §119 from Japanese Patent Application No. 2008-118735 filed on Apr. 30, 2008 in the Japan Patent Office, the entire contents of which are hereby incorporated herein by reference.

BACKGROUND OF THE INVENTION

1. Field of the Invention

Exemplary aspects of the present invention generally relate to an image forming apparatus, such as a copier, a facsimile machine, a printer, or the like, and more particularly, to an image forming apparatus including a sheet separation mechanism that separates sheets of a recording medium from a transport member using air.

2. Description of the background Art

Conventionally, a generally known image forming apparatus employs a fixation method using a heating roller. In such a fixation method, heat and pressure are applied to a unfixed toner image on a recording sheet in a nip portion where a pressure roller and a fixing roller including a halogen heater and so forth meet and press against each other while the recording sheet is carried in the nip and transported. Such a fixation method is widely used.

Alternatively, there is another known fixation method, known as a belt fixation method, in which an endless fixing belt is wound around and stretched between the heating roller including the halogen heater or the like and the fixing roller.

In this method, the fixing roller is pressed by a pressure roller through the fixing belt, forming the fixing nip. Heat and pressure are applied to the unfixed toner image on the recording sheet in the nip portion where the pressure roller and the fixing belt meet and press against each other while the recording sheet is transported therebetween.

This configuration allows the heat capacity of the fixing belt to be relatively small so that time for warming up can be reduced, resulting in power saving.

With the foregoing configurations, the toner image fused on the recording sheet contacts the fixing roller/belt. For this reason, the surface of the fixing roller or the fixing belt is coated with a material having good releasability, for example, fluororesin, so as to facilitate separation of the recording sheet from the fixing roller/belt. In addition, in order to physically separate the recording sheet from the fixing roller/belt belt, a separation pawl is employed.

However, a drawback to the use of a separation pawl is that, because the separation pawl contacts the fixing roller/belt, it may easily scratch the surface of the fixing roller/belt, leaving a scratch mark or a trace thereon. When this happens, the output image has undesirable markings such as streaks.

To counteract this possibility, in general, in a monochrome image forming apparatus, the fixing roller consists of a metal roller the surface of which is coated with Teflon in order to make the surface scratch-resistant. Accordingly, the product life of the fixing roller of this kind is relatively long.

The separation claw was used for a relatively long time because it was effective to prevent paper jams due to the recording sheet getting wound around the fixing roller.

However, in a case of a color image forming apparatus, in order to improve color enhancement, the fixing roller includes a surface layer formed of silicone rubber coated with fluorine. In general, a tube made of PFA having a thickness of some tens of microns is used for this purpose. Alternatively, the surface of the silicone rubber is coated with oil.

A drawback of the foregoing configuration is that the surface layer is relatively soft and thus damaged or scratched easily. As described above, when there is a scratch on the surface layer, the output image will have streaks.

In view of this, more recent color image forming apparatuses rarely employ the separation pawl or the like that directly contacts the fixing roller to separate the recording sheet from the fixing roller. Instead, such image forming apparatuses employ a contactless separation method.

However, a drawback of the contactless separation method is that it can cause paper jams when the viscosity of the toner and of the fixing roller is relatively high, causing the recording sheet to roll around the fixing roller after fixation. In particular, when a color image is formed, a plurality of color layers is overlaid on one another, increasing viscosity and thus causing paper jams more easily.

One example of a known separation technique employed in the color image forming apparatus uses a contactless separation plate that extends parallel to the fixing roller/belt in a longitudinal or width direction thereof. A slight gap of approximately 0.2 to 1 mm is provided between the fixing roller/belt and the separation plate.

Another example of known separation technique uses contactless separation pawls aligned with a predetermined interval between each other. A slight gap of approximately 0.2 to 1 mm is also provided between the fixing roller/belt and the separation pawls.

Still another approach is one in which the recording sheet is separated naturally from the fixing roller/belt using the resilience of the recording sheet itself and elasticity of a curved portion of the fixing roller/belt. This technique is a so-called self-stripping method.

In these known separation methods, a gap is provided between the fixing roller/belt and the separation members. Thus, when a relatively thin recording sheet or the recording sheet having a small or no margin at the leading edge is fed, or a solid image such as a photograph is printed, the recording sheet passes through the gap while sticking tightly to the fixing roller/belt, causing the recording sheet to wind around the fixing roller/belt or contact the separation plate and the separation pawls. As a result, paper jams occur.

In view of the foregoing, in order to help the contactless separation devices to separate the recording sheet from the fixing roller/belt, a method is proposed in which air is blown against a sheet separation area such as the nip portion where the pressure roller and the fixing roller meet.

Most air supply mechanisms include a compressor or air pump that compresses air, and air is injected using a solenoid valve that regulates air supply. This configuration allows a relatively large amount of air to be supplied at high pressure.

However, when the compressor is used, the size of the image forming apparatus as a whole increases. In addition, compression of air takes time until a desired high pressure is obtained. Consequently, the compressed air cannot be used immediately after the image forming apparatus is turned on.

Furthermore, the solenoid valve is required, thereby increasing the number of parts and thus significantly increasing the cost of the device. Moreover, when the compressor is driven, causing significant noise, it is not suitable for office use. Such an air supply mechanism tends to be large, consuming a significant amount of power, thereby defeating the purpose of power saving. Finally, the typical image forming apparatus using the compressor is usually a full-color high speed printing machine that tends to be large, expensive, and requiring a dedicated operator.

SUMMARY OF THE INVENTION

In view of the foregoing, in one illustrative embodiment of the present invention, a sheet separator using air includes a plurality of nozzles and a guide member. The plurality of nozzles, through which compressed air is ejected against a nip portion where a plurality of rotating members meets, presses each other, and carries a sheet of recording medium therebetween, is disposed downstream in a direction of sheet transport and also in a direction of a width of the recording medium. The guide member holds and secures the nozzles, and includes a conduit to supply the compressed air to the nozzles, and a guide surface to guide the recording medium separated from the nip portion. A tip of each of the nozzles from which air is ejected projects beyond the leading edge of the guide member on the nip portion side.

In another illustrative embodiment of the present invention, a fixing unit for fixing a toner image includes the sheet separator.

Yet in another illustrative embodiment of the present invention, an image forming apparatus for forming an image includes the sheet separator.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
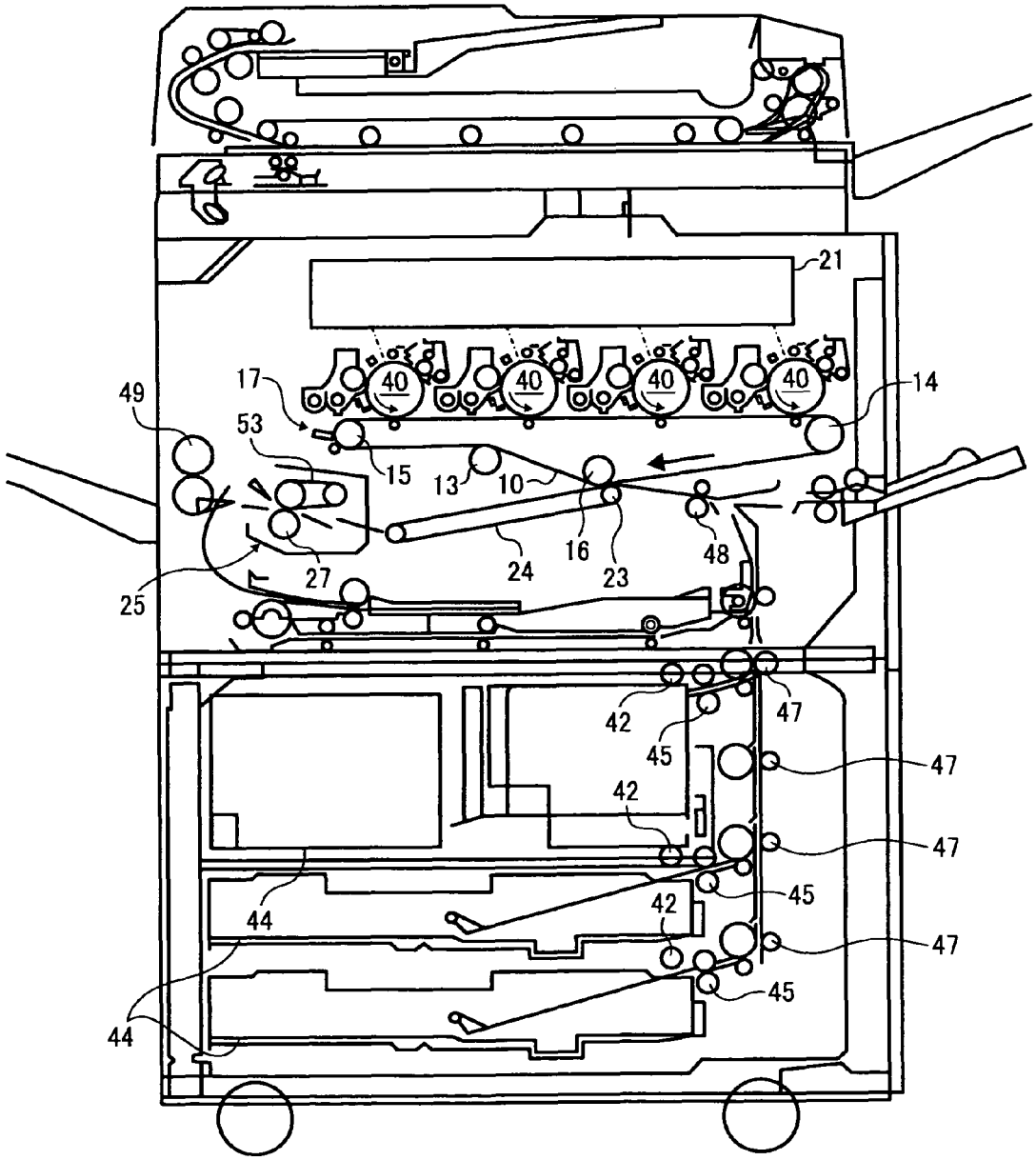
FIG. 1 is a schematic diagram illustrating an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

Referring now to FIG. 1, there is provided a schematic diagram illustrating a tandem type copier using an intermediate transfer method. The image forming apparatus in FIG. 1 includes an intermediate transfer member 10 substantially at the center thereof. In the present embodiment, the intermediate transfer member 10 is an endless belt. The intermediate transfer member 10 is wound around support rollers 13, 14, 15, and 16, and rotated in a clockwise direction.

In FIG. 1, a cleaning unit 17 is provided substantially at the left of the support roller 15. The cleaning unit 17 removes residual toner remaining on the intermediate transfer member 10 after image transfer and includes a blade-type cleaning member made of urethane or the like that contacts the intermediate transfer belt 10 in the direction opposite the rotation of the intermediate transfer member 10.

The residual toner collected by the cleaning member is transported to a rear side of the image forming apparatus by a transport member, not illustrated. Due to gravity, the toner falls into a toner recovery bottle, not illustrated, and is stored.

The toner recovery bottle includes a detector that detects an amount of toner recovered. When the toner recovery bottle is full, operation is stopped, thereby preventing overflow of the toner.

Substantially above the intermediate transfer belt 10, along the moving/transport direction thereof, four image forming stations for colors black, magenta, cyan, and yellow are provided in tandem and constitute a tandem image forming apparatus. Each image forming station includes a photoreceptor drum 40. The image forming stations for black, magenta, cyan, and yellow all have the same configuration, differing only in the color of toner employed.

Substantially above the tandem image forming stations, an exposure unit 21 is provided.

Substantially at the center of the bottom of the belt loop of the intermediate transfer member 10, opposite the support roller 16, a secondary transfer roller 23 of a secondary transfer unit is provided. The secondary transfer unit includes the secondary transfer roller 23 and a belt 24.

Substantially downstream the sheet transport direction of the secondary transfer unit including the secondary transfer roller 23 and the belt 24, a fixing unit 25 is provided to fix an image transferred onto a recording sheet. The fixing unit 25 includes a fixing belt 53 and a pressure roller 27 that presses against the fixing belt 53.

When a start button is depressed, a drive motor, not illustrated, drives one of the support rollers 14, 15, and 16. The other support rollers-including the support roller 13 follows the rotation, thereby rotating the intermediate transfer member 10. In the meantime, in each of the image forming stations, single-color images in black, magenta, cyan, and yellow are formed on the respective color of photoreceptor drums 40.

As the intermediate transfer belt 10 rotates, the images in different colors are sequentially and overlappingly transferred onto the intermediate transfer belt 10, thereby forming a composite color image on the intermediate transfer member 10.

When the start button is depressed, one of sheet feed rollers 42 is selected to rotate so as to feed the recording sheet from one of sheet cassettes 44 stacked on one another in a paper bank. One of the respective separation rollers 45 separates the recording sheet one sheet at a time and directs the recording sheet into a sheet feed path.

Subsequently, transport rollers 47 transport and guide the recording sheet to the sheet feed path in the image forming apparatus until the recording sheet contacts a pair of registration rollers 48.

The pair of the registration rollers 48 is rotated in appropriate timing such that the recording sheet is sent between the intermediate transfer member 10 and the secondary transfer roller 23, and aligned with the composite color image formed on the intermediate transfer belt 10. The secondary transfer roller 23 transfers the composite color image onto the recording sheet.

After the image is transferred onto the recording sheet, the belt 24 of the secondary transfer unit transports the recording sheet to the fixing unit 25 where heat and pressure are applied to the recording sheet to fix the image thereon.

After the image is fixed, a sheet discharge roller 49 discharges the recording sheet onto a sheet discharge tray.

The cleaning unit 17 cleans the intermediate transfer belt 10 after the image is transferred so that the residual toner remaining on the intermediate transfer belt 10 is removed therefrom in preparation for the subsequent imaging cycle.

Figure 2:
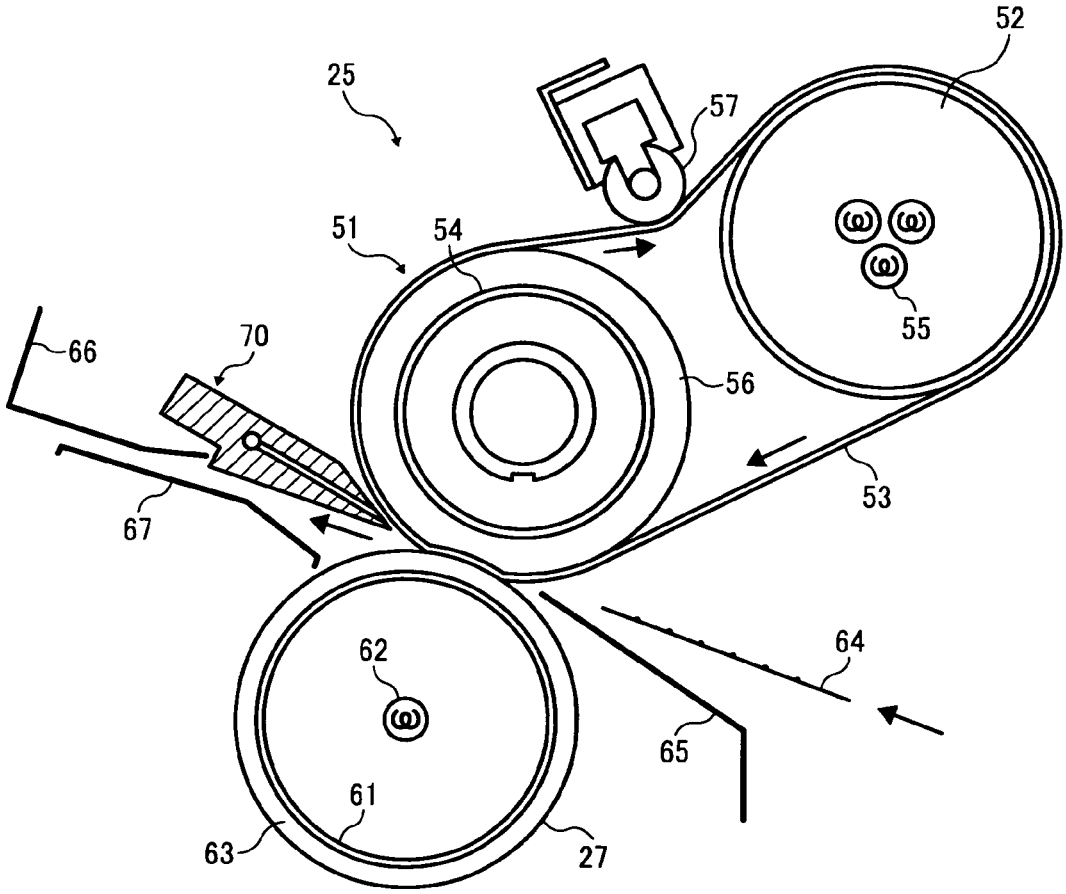
FIG. 2 is a schematic diagram illustrating a fixing unit employed in the image forming apparatus of FIG. 1 according to an illustrative embodiment of the present invention.

With reference to FIG. 2, a description is provided of the fixing unit 25. The fixing unit 25 according to the illustrative embodiment employs a belt fixing method that enables a temperature to rise quickly after power is turned on due to small heat capacity of the surface of the belt. Furthermore, hardness of the surface of the fixing roller is softer than the surface hardness of the pressure roller.

that is, rubber layer of the fixing roller is relatively thick, so that the recording sheet that exits the nip portion between the fixing roller and the pressure roller falls downward, thereby facilitating the recording sheet to separate from the fixing roller/belt.

Alternatively, as long as releasability of a sheet separator 70 described later can be maintained, the surface hardness of the fixing roller and the pressure roller can be similar, or if not the same, and the recording sheet can be discharged from the roller nip portion in a direction of tangent.

As illustrated in FIG. 2, the fixing unit 25 includes a fixing roller 51, a heating roller 52 including three heaters 55 inside thereof, the fixing belt 53, and so forth. The three heaters 55 in the heating roller 52 heat the surface of the fixing belt 53. Subsequently, in the nip portion where the fixing roller 51 and the pressure roller 27 meet and press each other, the fixing belt 53 being heated heats and presses an unfixed image on the recording sheet. Accordingly, the image is fixed onto the recording sheet.

According to the illustrative embodiment, the fixing belt 53 includes a base material of polyimide film covered with a silicone rubber layer.

The fixing roller 51 includes a core metal 54. The surface of the core metal 54 includes a rubber layer 56.

The fixing belt 53 is wound around the fixing roller 51 and the heating roller 52, and stretched at a predetermined tension by a belt tension member 57.

The pressure roller 27 includes a core metal 61 and a heater inside thereof. The surface of the core metal 61 includes a rubber layer 63. The heater 62 is provided so as to heat the fixing nip portion from the pressure roller 27, thereby preventing the temperature of the fixing nip portion from decreasing.

In order to enhance heat resistance and color of an image, the rubber layers 56 and 63 are formed of silicone rubber. By changing thickness of the rubber layers, in particular, by forming a thickness of the rubber layer 56 of the fixing roller 51 substantially thicker than the rubber layer 63 of the pressure roller 24, the rubber layer 63 sinks into the fixing roller 51.

According to the illustrative embodiment, the surface of both the fixing belt 53 and the pressure roller 27 is formed of silicone rubber having some viscosity. Thus, silicon oil is slightly applied on the belt surface so as to easily separate a recording sheet 64 therefrom.

Substantially upstream the nip portion, a guide board 65 is provided to guide the recording sheet 64 to the nip portion between the fixing roller 51 and the pressure roller 27.

After the recording sheet 64 exits the nip portion, the recording sheet 64 is guided substantially below the sheet separator 70 and passes between the sheet separator 70 and a lower guide 67. Subsequently, the recording sheet 64 is discharged through an upper guide 66 and the lower guide 67.

Figure 3:
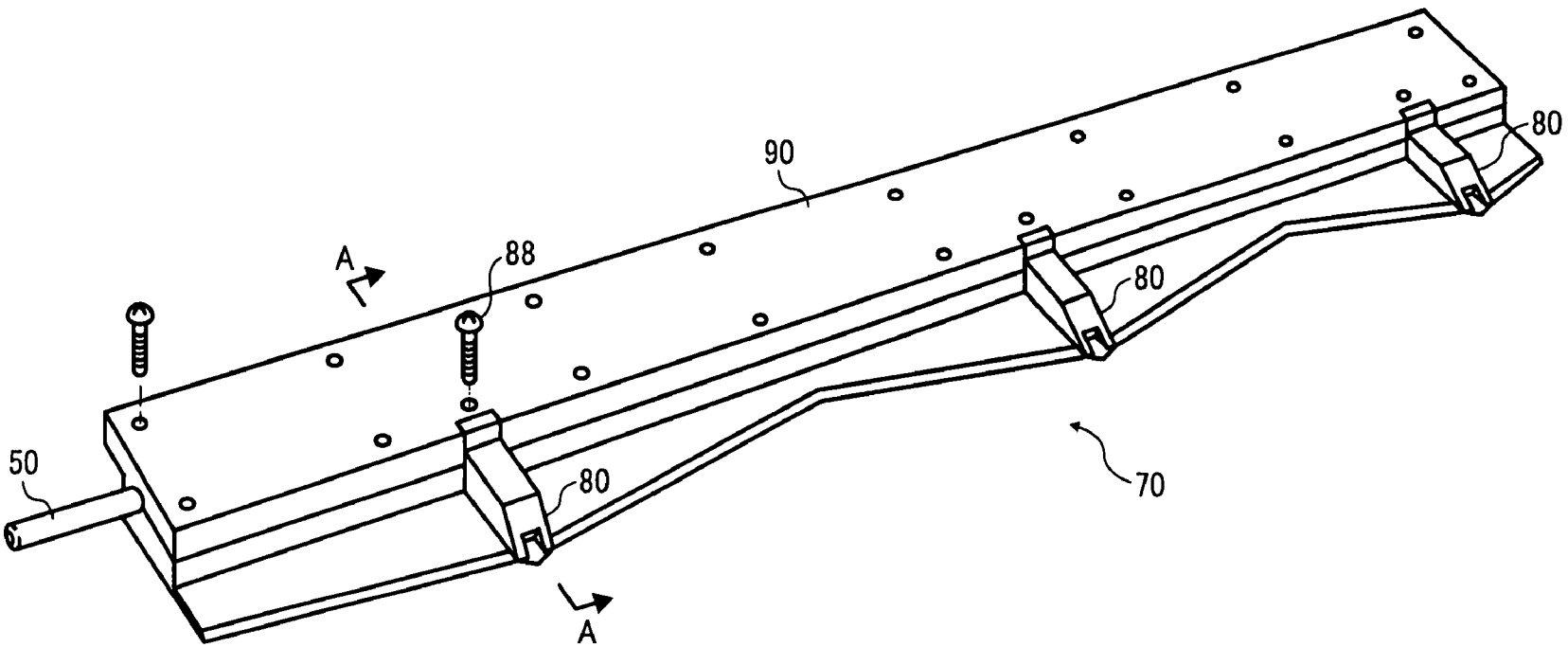
FIG. 3 is a perspective view of a sheet separator according to an illustrative embodiment of the present invention.

Referring now to FIG. 3, there is provided a perspective view illustrating the sheet separator 70 according to the illustrative embodiment of the present invention. The sheet separator 70 includes a guide member 90, a plurality of nozzles. 80, a tube 50, and so forth.

The nozzles 80 are disposed at a constant pitch, that is, with a predetermined interval between each other in a longitudinal direction of the guide member 90, that is, in the direction of the width of the recording sheet 64 being transported. Immediately before the recording sheet 64 exits the nip portion, an air pump, described later, supplies air through the tube 50, to the nozzles 80, which then expel the air under pressure so that the recording sheet 64 is separated from the nip portion.

According to the illustrative embodiment shown in FIG. 3, three nozzles 80 are provided. However, the number of nozzles 80 is not limited to three. In terms of separation of the sheet by air pressure, it is preferable to have as many nozzles as possible. Even so, separation of the recording sheet can be realized as long as air is discharged from a plurality of locations in the direction of the width of the recording sheet.

The tips of the nozzles 80 of the sheet separator 70 project from the leading edge of the sheet separator 70, which end gradually recedes toward both lateral sides thereof.

Figure 4:
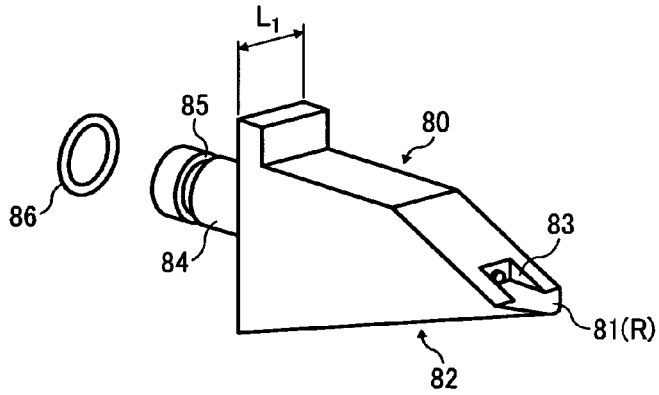
FIG. 4 is a perspective view of an example of a nozzle of the sheet separator of FIG. 3 according to an illustrative embodiment of the present invention.

Referring now to FIG. 4, there is provided a perspective view illustrating one of the nozzles 80 according to the illustrative embodiment. The nozzle 80 is formed of heat resistant resin. A tip portion 81 has a substantially round shape. A bottom surface 82 is substantially flat. The tip portion 81 and the bottom surface 82 are coated with fluorine.

Ideally, the sheet separator 70 is formed entirely of heat resistant resin, and the surface thereof is coated with fluorine. However, due to the cost involved, it is sufficient if only the nozzles 80 are formed of heat resistant resin coated with fluorine.

According to the illustrative embodiment, the material for the nozzle 80 includes Vespel® manufactured by DuPont. The fluorine coating includes two layers of PFA. Experiments confirmed that damage such as peeling and scratching did not occur, and heat resistance and long product life were assured.

Alternatively, as long as the bottom surface 82 is made highly flat and smooth, fluorine coating is not necessary.

The thickness of the round-shape tip portion 81 is approximately 0.1 mm to 0.2 mm. The bottom portion thereof is flat.

In FIG. 4, a width L1 of the nozzle 80 substantially corresponds to a width L2 of a notch of the guide member 90 described later (see FIG. 6). The nozzles 80 are attached to the guide member 90.

Walls 83 for directing injected air are formed at both sides of an opening of the nozzle 80 from which air is ejected. The walls 83 prevent the air being ejected from dissipating, thereby concentrating the direction of ejection and thus enhancing the impact of the air.

The nozzle 80 includes a tube 84 at the back of the nozzle 80. The tube 84 serves as both a connector that connects to a nozzle mounting portion (opening) 98 of the guide member 90 and an opening for air induction (see FIG. 7). The tube 84 includes a groove 85. An O-ring 86 is fitted to the groove 85.

Figure 5:
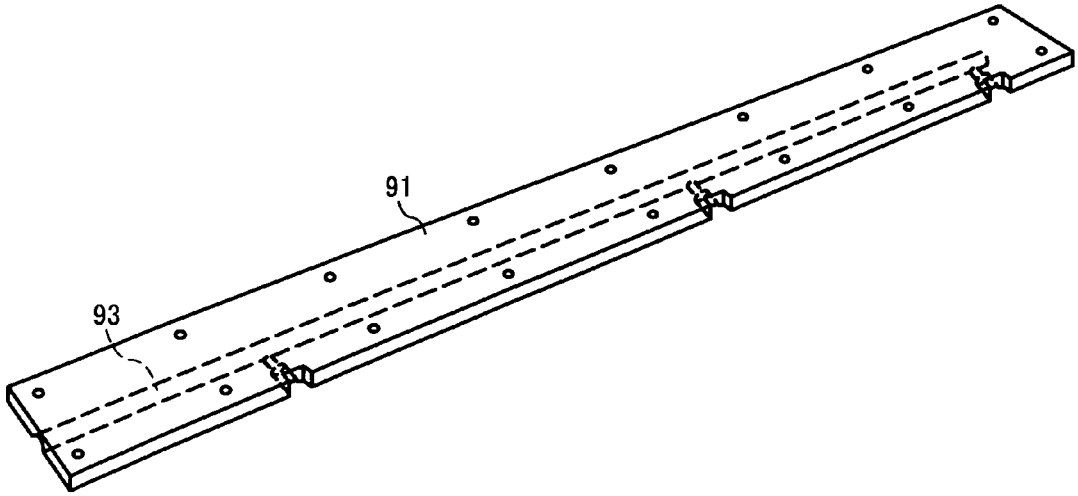
FIG. 5 is a perspective view of an upper plate of a guide member of the sheet separator according to an illustrative embodiment of the present invention.
Figure 6:
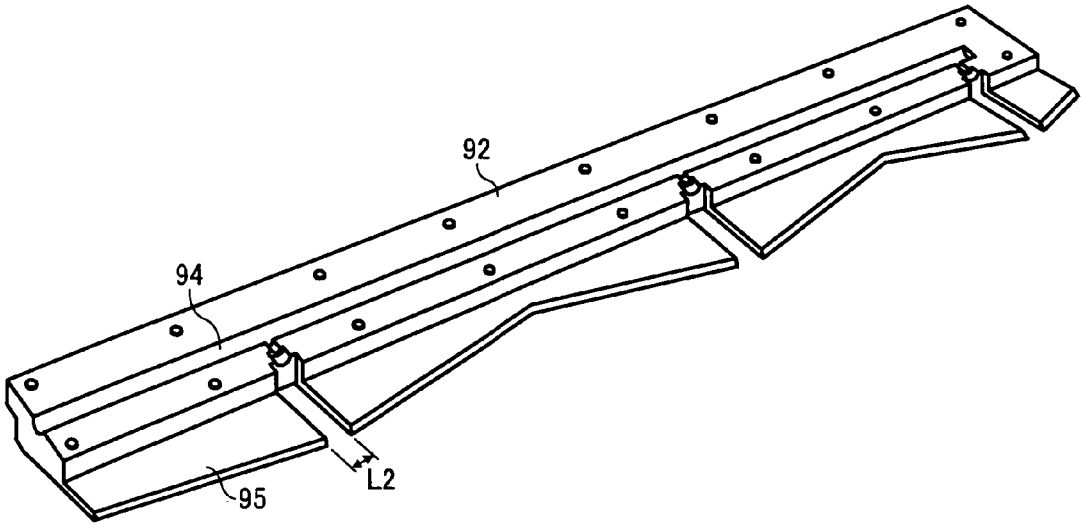
FIG. 6 is a perspective view of a lower plate of the guide member of the sheet separator according to an illustrative embodiment of the present invention.
Figure 7:
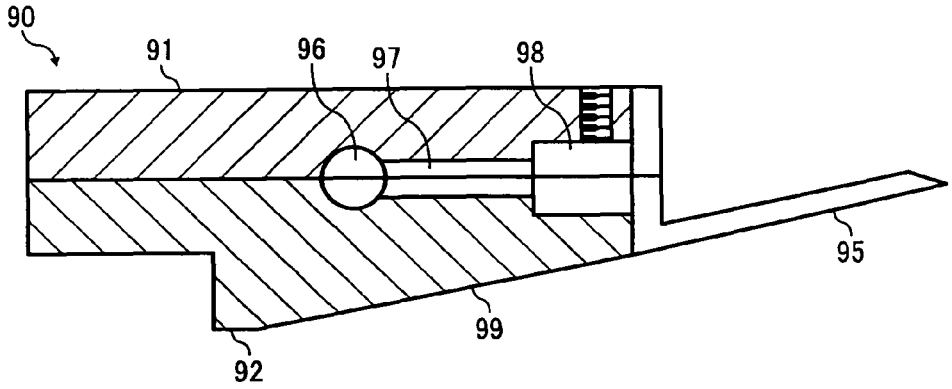
FIG. 7 is a cross-sectional view of the guide member according to an illustrative embodiment of the present invention.

Referring now to FIGS. 5 through 7, a description is provided of the guide member 90. FIG. 5 is a perspective view of an upper plate 91 of the guide member 90 of the sheet separator 70. FIG. 6 is a perspective view of a lower plate 92 of the guide member 90. FIG. 7 is a cross-sectional view of the guide member 90.

As illustrated in FIG. 7, the guide member 90 includes the upper plate 91 on the lower plate 92.

The upper plate 91 and the lower plate 92 include grooves 93 and 94, respectively. The grooves 93 and 94 are semicircular in cross section and extend in the longitudinal direction as well as in the sheet transport direction connected to the nozzle mounting position. When the upper plate 91 is disposed on top of the lower plate 92, the grooves 93 and 94 form an air conduit that is circular in cross section.

Both the bottom surface of the upper plate 91 that contacts the upper surface of the lower plate 92 and the upper surface of the lower plate 92 have a smooth surface so as to prevent air from leaking from the upper plate 91 and the lower plate 92 when the upper plate 92 and the lower plate 92 are sealed together using a plurality of fastening means. In this case, the fastening means are screws.

Alternatively, in order to enhance the seal, a film-type packing is adhered to the contact surface of the upper plate 91 and lower plate 92, or a sealing agent (a liquid packing) is applied to the contact surface of the upper plate 91 and lower plate 92.

The nozzle mounting portion of the upper plate 91 and the lower plate 92 includes notches. The width L2 of the notch is configured such that the nozzle 80 is tightly fitted to the notch. As will be later described, in a case in which a slight gap is created between the nozzle 80 and the nozzle mounting portion of the upper plate 91 and the lower plate 92 in the direction of both the width and the depth of the notch, the O-ring 86 prevents air from leaking.

The walls of the notch of the upper plate 91 and the lower plate 92 of the guide member 90 form a substantially right angle in the longitudinal direction (width direction) and the sheet transport direction (front and rear direction). Accordingly, when the nozzle 80 is inserted into the notch, misalignment or tilt of the nozzle 80 can be prevented.

As illustrated in FIG. 6, the lower plate 92 includes a relatively thin leading member 95. The leading edge projects from the leading member 95 at the nozzle mounting portion, and recedes toward both lateral sides of the lower plate 92 from the nozzle mounting portion.

Figure 8:
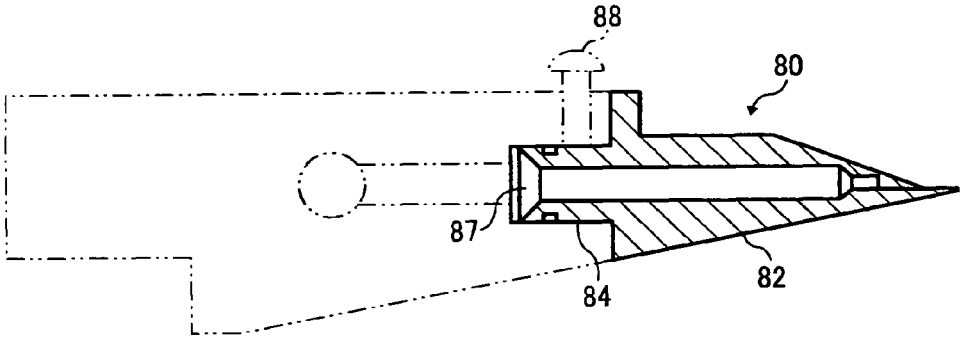
FIG. 8 is a cross-sectional view of the nozzle according to an illustrative embodiment of the present invention.
Figure 9:
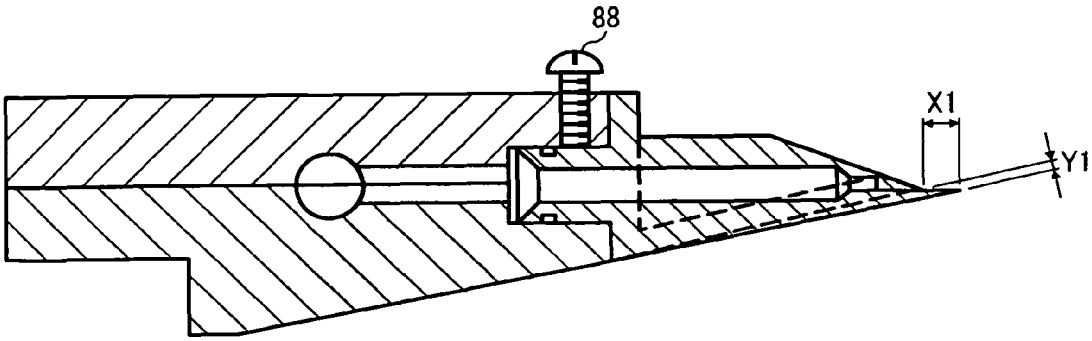
FIG. 9 is a cross-sectional view of the nozzle mounted to the guide member according to an illustrative embodiment of the present invention.

Referring now to FIG. 7, there is provided a cross-sectional view of the guide member 90 along line A-A in FIG. 3. FIG. 8 is a cross-sectional view of the nozzle 80 associated with the guide member 90 in FIG. 7. FIG. 9 is a cross-sectional view of the sheet separator 70 including the nozzle 80 when mounted to the guide member 90.

As illustrated in FIG. 7, when the upper plate 91 is provided on the lower plate 92, constituting the guide member 90, the groove 93 of the upper plate 91 and the groove 94 of the lower plate 92 form an air conduit 96 extending in the longitudinal direction and a divergent path 97 off the air conduit 96. The nozzle mounting opening 98 is provided substantially at the front of the divergent path 97. The tube 84 of the nozzle 80 (see FIGS. 4 and 8) fits into the nozzle mounting opening 98. A bottom surface 99 of the lower plate 92 serves as a guide for sheet discharge.

As illustrated in FIG. 8, when the nozzle 80 is mounted and secured to the guide member 90 using a screw 88, the O-ring 86 fitted to the groove 85 seals a slight gap between the nozzle 80 and the guide member 90, thereby preventing air from leaking therefrom. Furthermore, when the rear end of the tube 84 includes a chamfered portion 87, air can be smoothly induced. It is to be noted that the nozzle 80 is detachably mountable relative to the guide member 90.

When the nozzle 80 is mounted and fastened to the guide member 90 by the screw 88 as illustrated in FIGS. 4 and 8, the thin leading member 95 is positioned slightly above the bottom surface 82 of the nozzle 80 by an amount Y1. The tip portion of the nozzle 80 protrudes from the guide member 90 by an amount X1 toward the nip portion. In other words, the nozzle 80 protrudes from the guide member 90.

Figure 10:
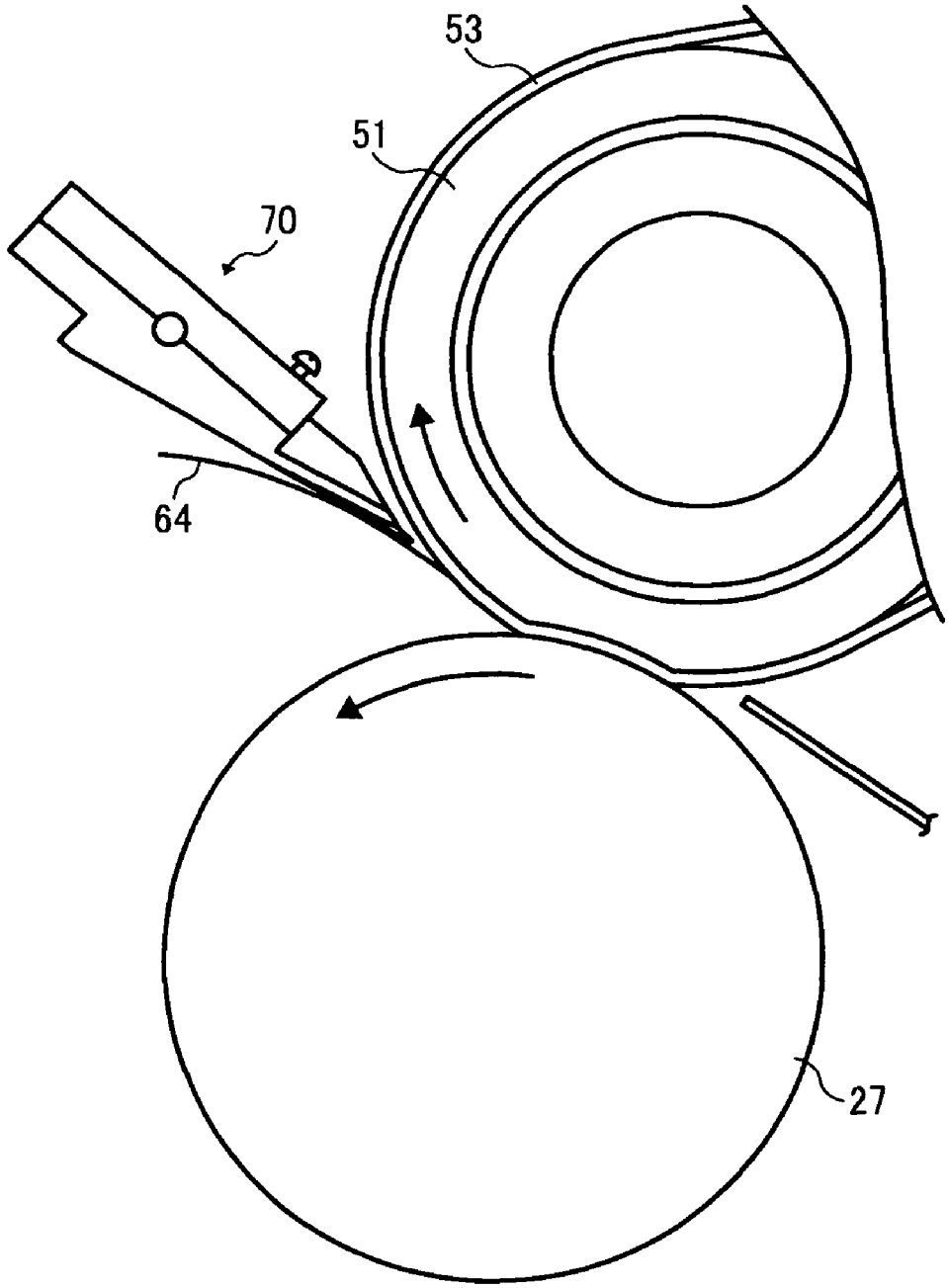
FIG. 10 is an enlarged view of the sheet separator provided to the fixing unit according to an illustrative embodiment of the present invention.

With this configuration, as illustrated in FIG. 10, the recording sheet 64 that exits the nip portion contacts the nozzle 80 and then contacts the separation sheet plate 90. Subsequently, the recording sheet 64 is discharged along the separation sheet plate 90. As described above, since the surface of the nozzle 80 is coated, the recording sheet 64 is reliably separated.

As can be understood from FIG. 10, when the nozzle 80 is fitted into the notch of the guide member 90, the nozzle 80 and the guide member 90 are integrated, thereby reducing the height (thickness) of the sheet separator 70 as a whole and thus allowing the tip of the nozzle 80 to approach the nip portion. Accordingly, air can be efficiently ejected from the nozzle and into the nip portion, thereby enhancing separation performance and facilitating separation of the recording sheet.

Solely in terms of separability of the recording sheet, preferably the tip of the nozzle 80 has an acute angle. In this case, however, the sharp tip may damage the recording sheet and/or the transfer belt when a paper jam occurs. Furthermore, there is a possibility that the sharp tip may hurt a hand of an operator when fixing the paper jam.

In light of this, the tip of the nozzle 80, that is, the tip portion 81 is rounded, with a tip portion R as indicated in FIG. 4. According to the illustrative embodiment, the tip portion R is approximately 0.5 mm to 1 mm.

The recording sheet is discharged along the bottom surface 82 of the nozzle 80. When the bottom surface 82 is not smooth, it scratches the image on the recording sheet leaving a streak thereon. Thus, the bottom surface 82 has a smooth surface.

When the recording sheet 64 contacts the nozzle 80 across the width of L1, the impact on the recording sheet 64 can be dispersed, thereby preventing damage to the image on the recording sheet 64. Furthermore, since the nozzle 80 is coated with fluorine, a substance such as toner is prevented from sticking thereto.

As can be seen in FIG. 10, there is a slight gap between the leading edge of the recording sheet 64 and the tip of the nozzle 80 as the recording sheet 64 separates. Thus, when the thickness of the nozzle tip is relatively thick, or the air pressure is weak, or the gap between the fixing roller/belt and the nozzle tip is relatively large, paper jams easily occur.

When an experiment was performed in which the gap was approximately 0.8 to 1 mm, the air pressure at the nozzle opening was approximately 0.01 Mpa, three nozzles were provided, the thickness of the nozzle tip was approximately 0.1 to 0.2 mm, and a margin of the recording sheet from the front end of an image is approximately 1 mm, it was confirmed that 1000 sheets of recording sheets including coated paper in total weight of approximately 45 kg to 135 kg were separated successfully.

According to the illustrative embodiment, the sheet separator 70 is situated closer to the fixing roller 51 than the pressure roller 27. Alternatively, when the image forming apparatus includes a duplex printing function, the sheet separator 70 can be provided substantially at the pressure roller side, and it is preferable that air is blown against both the fixing roller/belt side and the pressure roller side.

Next, a description is provided of an air supply device 1000 that supplies air to the nozzle 80. The air supply device 1000 that supplies air to the sheet separator according to the illustrative embodiment is relatively small and is not limited to the specifically disclosed embodiments. The air supply device 1000 can use a conventional compressor.

Figure 11:
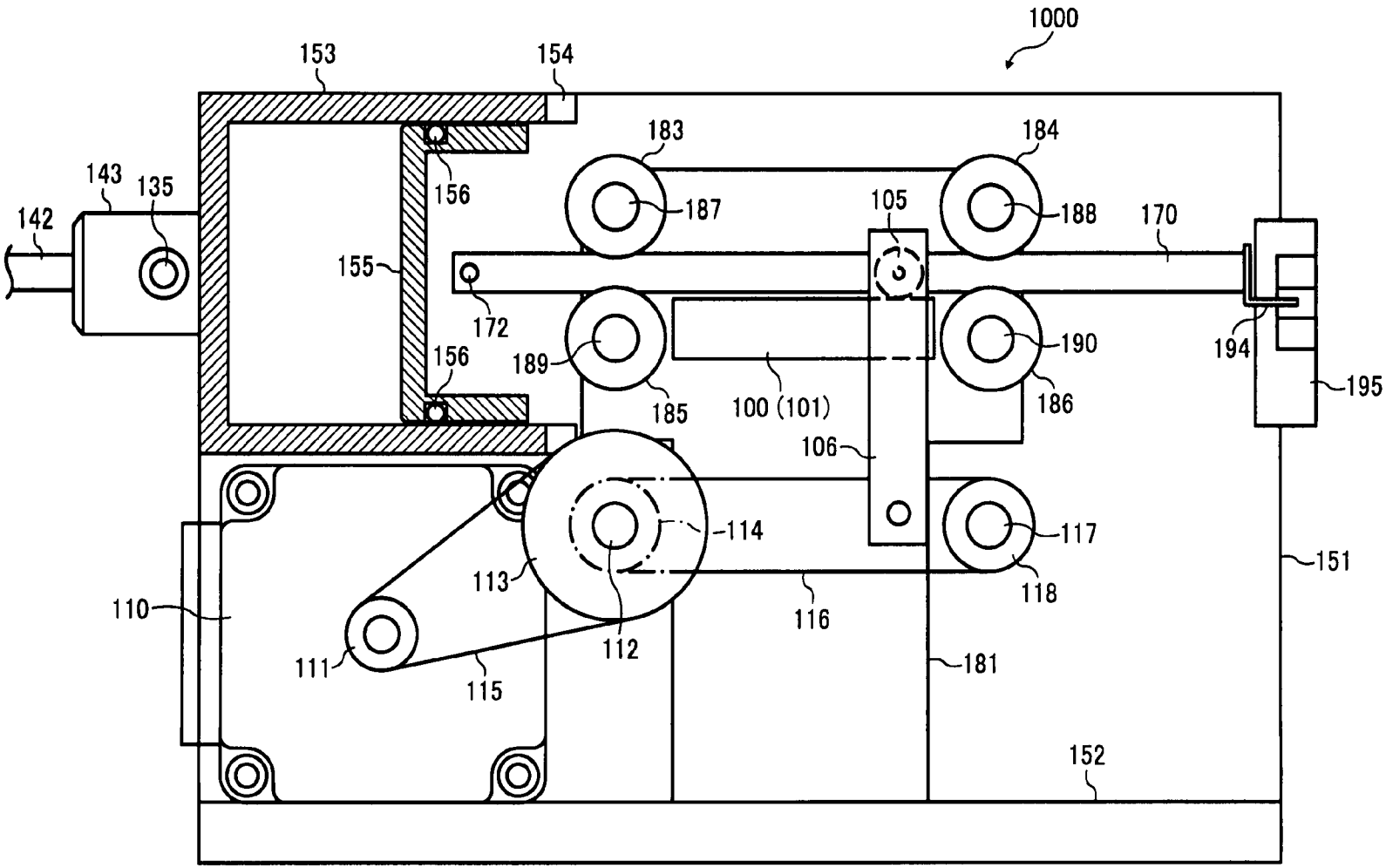
FIG. 11 is a vertical cross-sectional view of an air supply device as viewed from the front according to an illustrative embodiment of the present invention.
Figure 12:
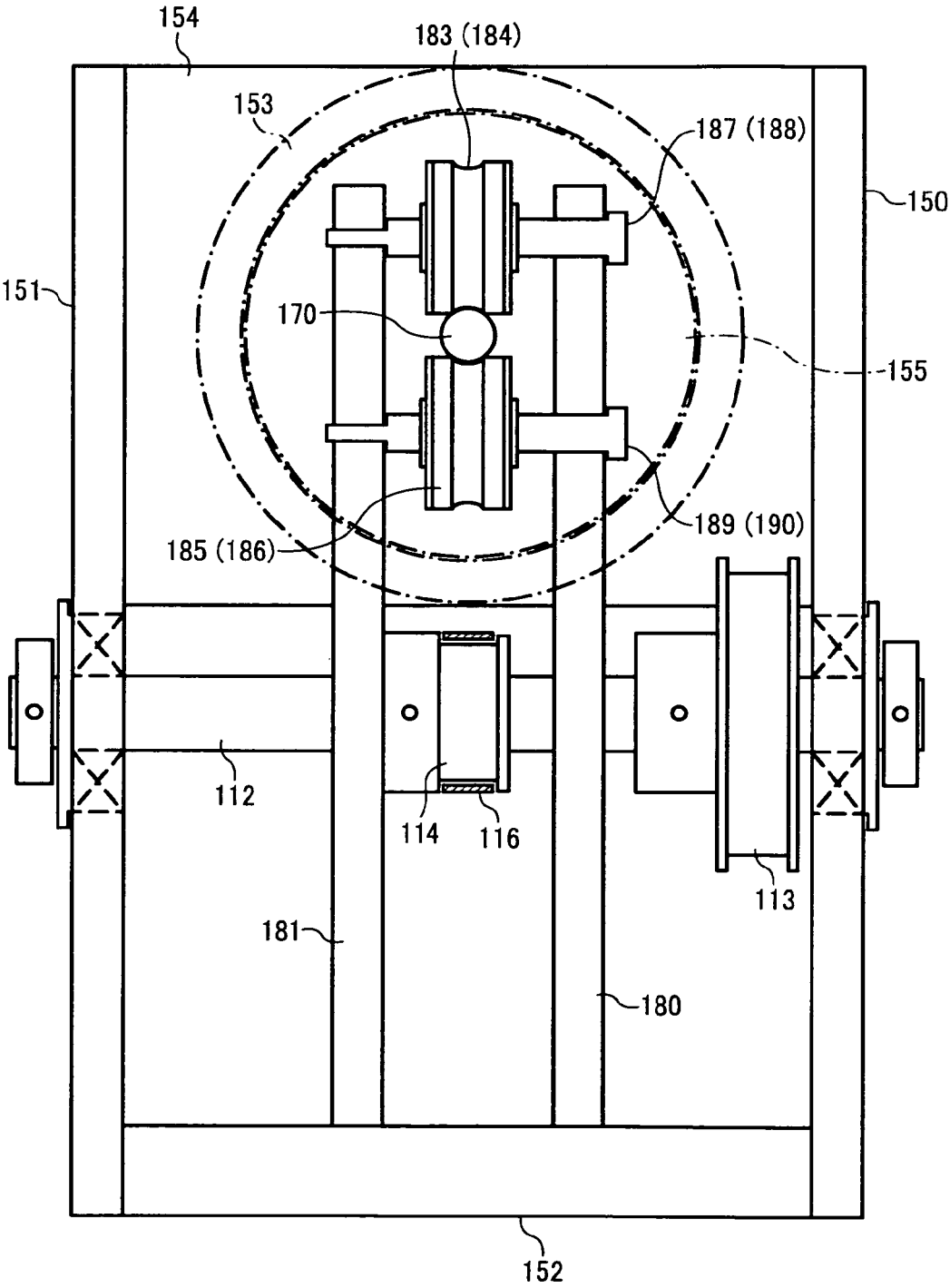
FIG. 12 is a right cross-sectional view of the air supply device of FIG. 11 according to an illustrative embodiment of the present invention.
Figure 13:
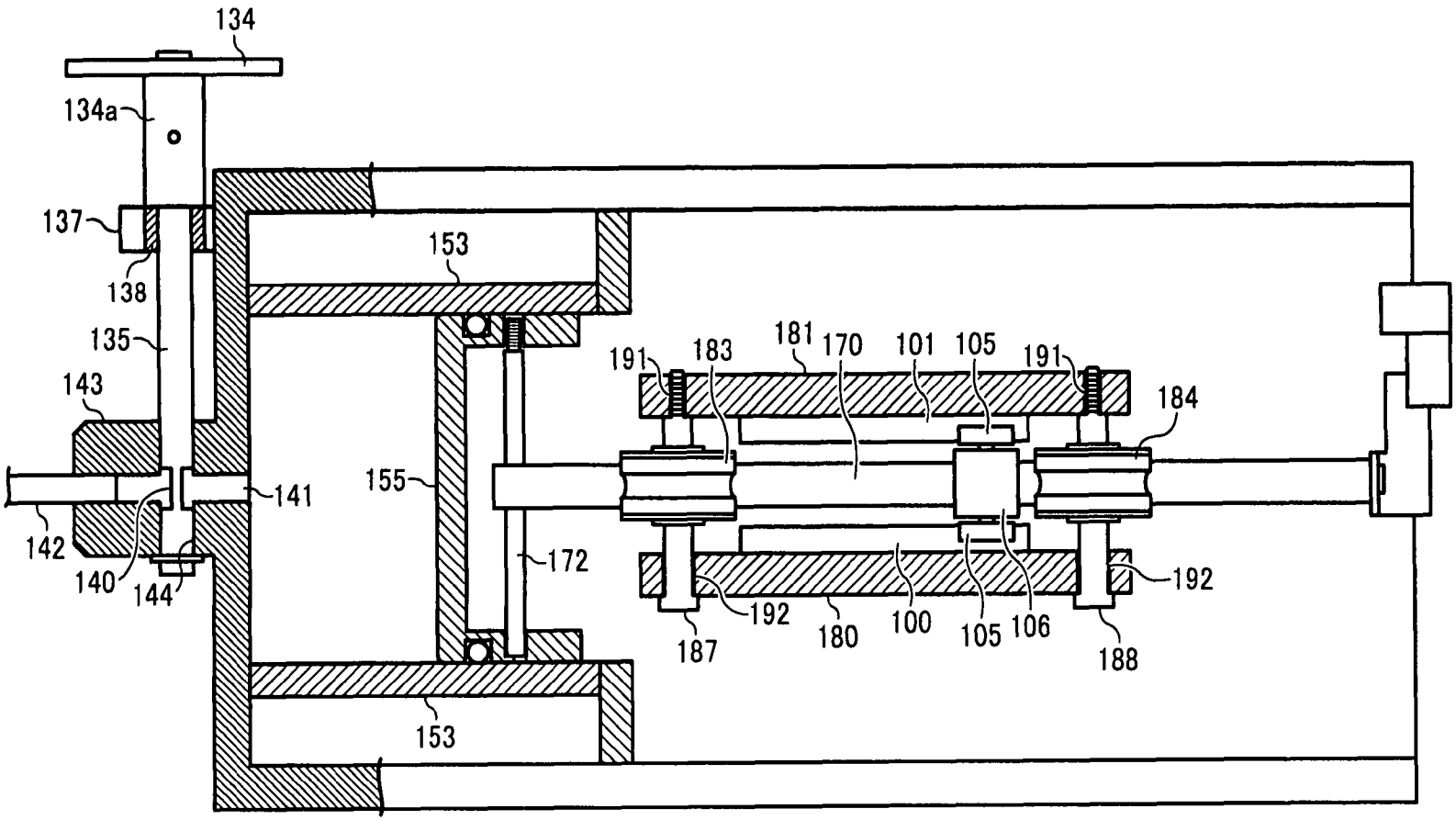
FIG. 13 is a cross-sectional view of a pump of the air supply device according to an illustrative embodiment of the present invention.
Figure 14:
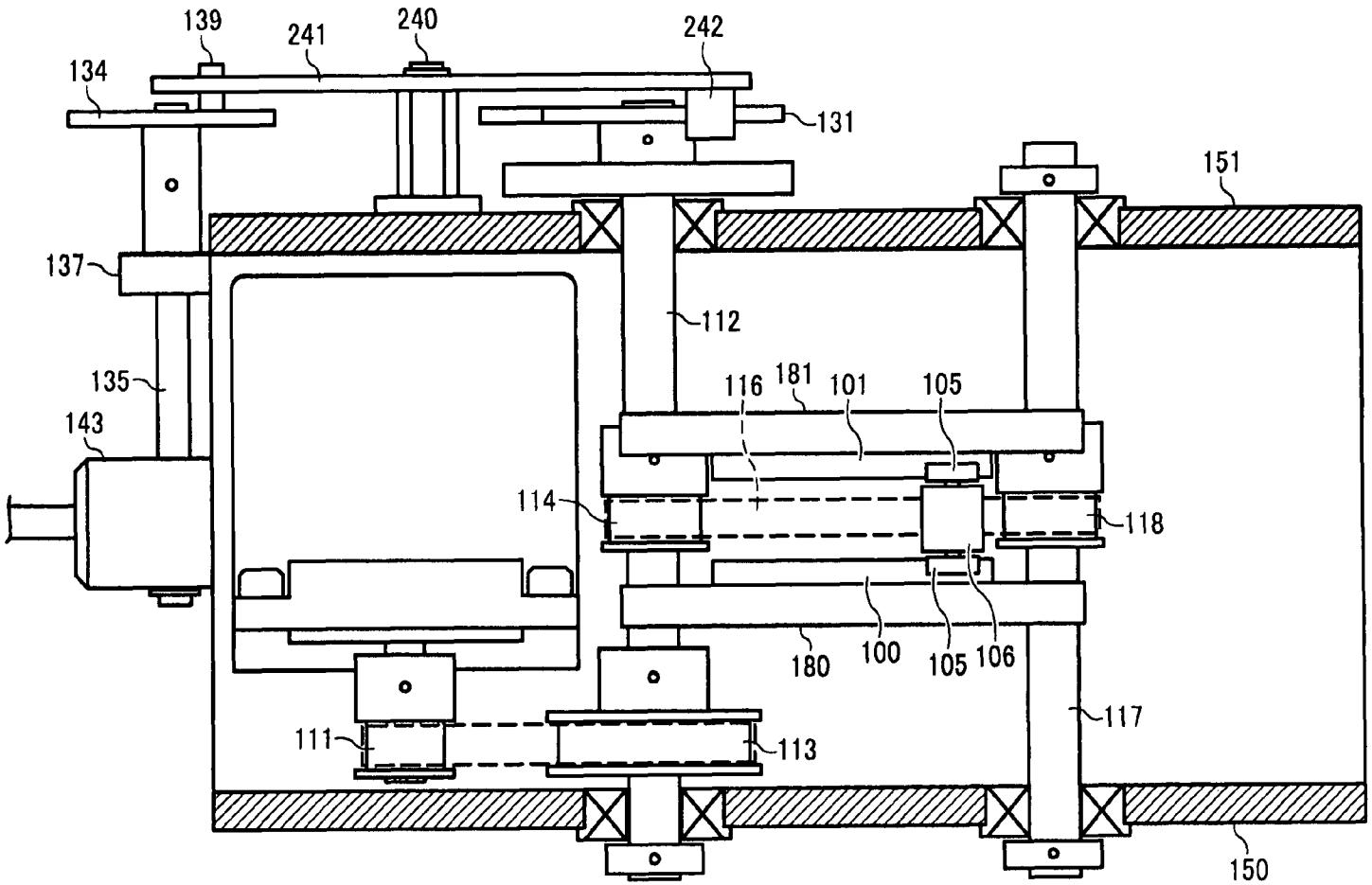
FIG. 14 is a cross-sectional view of a drive mechanism of the air supply device according to an illustrative embodiment of the present invention.

FIG. 11 is a vertical sectional view as viewed from the front of the air supply device 1000. FIG. 12 is a vertical sectional view-as viewed from the side of the air supply device 1000, that is, the left side in FIG. 11. FIG. 13 is a cross sectional view of a pump portion of the air supply device 1000. FIG. 14 is a cross sectional view of a drive portion of the air supply device 1000.

As illustrated in FIG. 12, the air supply device 1000 includes a front panel 150, a rear panel 151, and a bottom panel 152 that constitute a housing of the air supply device 1000. Between the front panel 150 and the rear panel 151, a cylinder 153 and a cylinder retainer 154 are fastened to the front panel 150 and the rear panel 151 by screws. The cylinder retainer 154 supports the cylinder 153 substantially from the back thereof.

In the cylinder 153, a piston 155 is provided and reciprocally moves to the left and right in FIG. 11 by a later described mechanism. On the front end surface of the cylinder 153 includes a boss 143 that protrudes therefrom as illustrated in FIG. 11.

As illustrated in FIG. 13, an air outlet 141 is provided inside the boss 143 so as to inject air from inside the cylinder 153. A tube 142 is fitted substantially to the front end of the air outlet 141. When the piston 155 moves, the air inside the cylinder 153 compressed by the piston 155 is injected outside through the air outlet 141 and the tube 142.

The following description pertains to the configuration and operation of the air supply device 1000 according to the illustrative embodiment.

As illustrated in FIG. 12, on the bottom panel 152, a pair of retaining plates 180 and 181 is vertically provided. Four rod shafts 187 through 190 are provided to the retaining plates 180 and 181.

As illustrated in FIGS. 12 and 13, one end of each of the rod shafts 187 through 190 includes a screw portion, and the other end has a relatively large diameter so as to prevent the rod shafts from falling. A groove is formed on the surface of the end portion having the large diameter so that the rod shafts 187 through 190 are fastened by a driver or the like.

As illustrated in FIG. 13, four screw holes 191 are provided to the retaining plate 181. Four fitting holes 192 are provided to the retaining plate 180. Each of the rod shafts 187 through 190 are inserted into the fitting holes 192 of the retaining plate 180 and through the screw holes 191 of the retaining plate 181, and fastened, thereby securely fixing the rod shafts 187 through 190 between the retaining plate 180 and 181.

Guide rollers 183 through 186 are rotatably mounted to each of the rod shafts 187 through 190 and positioned in a shaft direction by E-type retaining rings provided to each of the rod shafts 187 through 190 at both sides of the guide rollers.

As illustrated in FIGS. 12 and 13, the diameter of the center of the guide rollers 183 through 186 in the shaft direction is smaller than the diameter at both sides thereof. The portion of the guide rollers having the small diameter, forms an R-shape groove (depression) at the center thereof so as to accommodate a guide shaft 170. According to the illustrative embodiment, the outer shape of the guide shaft 170 is circular in cross section.

Alternatively, the substantially the center portion of the guide rollers 183 through 186 has a V-shape groove (depression).

The guide shaft 170 is provided between the guide rollers 183 through 186 each disposed at the top, the bottom, the left and the right. The guide shaft 170 is guided by the guide rollers 183 through 186 so as to be able to linearly and reciprocally move between the left and the right direction in FIGS. 11 and 13.

In order to prevent the guide rollers 183 through 186 and the guide shaft 170 from rattling when the rod shafts 187 through 190 are mounted to the screw holes 191 and the fitting holes 192, the screw holes 191 and the fitting holes 192 are accurately positioned relative to the retaining plates 180 and 181 so that the guide shaft 170 can move smoothly.

As described above, since the guide rollers 183 through 186 support the guide shaft 170 from both the top and the bottom and the guide rollers 183 through 186 are positioned in the shaft direction by the E-type retaining rings relative to the rod shafts 187 through 190, the guide shaft 170 is prevented from drifting in the front and the back directions or in the vertical direction as the guide shaft 170 travels. With this configuration, the guide shaft 170 is enabled to accurately and linearly travel. In the present embodiment, the guide shaft 170 travels horizontally.

A description is now provided of the piston 155. Referring back to FIG. 11, the piston 155 provided inside the cylinder 153 is mounted substantially at the front end of the guide shaft 170, that is, substantially at the left end in FIG. 11, through a rod 172.

A groove is formed in the vicinity of the tip portion of the piston 155, and an O-ring 156 is fitted thereto. Substantially at the rear end of the guide shaft 170, that is, substantially at the right end in FIGS. 11 and 13, a filler 194 is fastened by a screw. The filler 194 detects the position of the piston 155.

A detector 195 is a transmissive-type optical sensor that detects the filler 194. When the guide shaft 170 travels in the right direction in FIGS. 11 (13) and the tip of the filler 194 blocks the light of the detector 195, a drive motor, later described, is halted. According to the illustrative embodiment, FIGS. 11 and 13 illustrate a home position of the pump.

According to the illustrative embodiment, the cylinder 153 and the piston 155 have a cylinder shape. As described above, the guide shaft 170 accurately linearly travels so that the piston 155 moves reciprocally (parallel) in the cylinder 153.

As a pump, the piston needs to move linearly or parallel. In addition, it is important to prevent rotation of the piston. When the piston 155 rotates causing the guide shaft 170 to rotate, the filler 194 also rotates. Consequently, the filler 194 does not come in view of detection field of the detector 195 and thus collides against the detector 195. Furthermore, since the present invention employs the belt driving method, the drive belt may tilt, thus causing instability in driving.

To address such problems, according to the illustrative embodiment, the piston 155 is prevented from rotation. As illustrated in FIG. 13, rails 100 and 101 are provided facing the upper surface of the retaining plates 180 and 181.

As illustrated in FIGS. 11 and 13, a drive arm 106 engages the guide shaft 170. In particular, an insertion hole, through which the guide shaft 170 is inserted, is provided substantially at an upper portion of the drive arm 106. Furthermore, the drive arm 106 includes another hole different from the insertion hole in the direction perpendicular to the insertion hole. A shaft pin, not illustrated, is fitted into this hole.

The shaft pin is fit into a through-hole, not illustrated, provided to the guide shaft 170. The shaft pin is disposed perpendicular to the guide shaft 170. Rollers 105 are rotatably provided at both ends of the shaft pin so as to travel on the rails 100 and 101. The rollers 105 are secured by E-type retaining rings, not illustrated, preventing the rollers 105 from falling off from the shaft pin.

When the rollers 105 are provided to the shaft pin pressed into the guide shaft 170 and travel on the rails 100 and 101, the piston 155 provided to the guide shaft 170 is prevented from being rotated. In other words, the rollers 105 contact at least one of the rails 100 or 101, thereby preventing the piston 155 from being rotated.

Next, a description is provided of a driving mechanism of the piston 155. As illustrated in FIGS. 11, a stepping motor 110 is provided as a drive source in the air supply device 1000 according to the illustrative embodiment. The stepping motor 110 includes a pulley 111 fixed to a motor shaft. A drive shaft 112 is pivotally supported between the front panel 150 and the rear panel 151. Another pulley, that is, a pulley 113, is mounted and fixed to the drive shaft 112.

A first drive belt 115 serving as a timing belt is stretched between the pulley 111 and the pulley 113.

A drive pulley 114 is fixed to the drive shaft 112. An idler shaft 117 is pivotally supported parallel to the drive shaft 112 between the front panel 150 and the rear panel 151. An idler pulley 118 is fixed to the idler shaft 117. A second drive belt 116 serving as a timing belt is stretched between the drive pulley 114 and the idler pulley 118.

The upper loop of the second drive belt 116 is secured substantially at the bottom end portion of the drive arm 106 connected to the guide shaft 170 by a screw, thereby securely fastening the drive arm 106 to the second drive belt 116.

With this configuration, rotation of the stepping motor 110 is transmitted to the drive shaft 112 through the first drive belt 115, and further transmitted to the drive arm 106 from the drive shaft 112 through the second drive belt 116, causing the guide shaft 170 connected to the drive arm 106 to move in the left and the right directions of FIG. 11. As a result, the piston 155 travels in the cylinder 153.

The stepping motor 110 is used as the drive source according to the illustrative embodiment. The number of steps for the stepping motor 110 is configured such that the piston 155 travels between the home position illustrated in FIG. 11 and a compression position (top dead center) at which a volume of the cylinder 153 is at minimum. The home position according to the illustrative embodiment is bottom dead center at which the volume of the cylinder 153 is at maximum.

When power is turned on, the home position is verified based on an output of the detector 195, and piston 155 is halted at the home position. Based on that position, the stepping motor 110 rotates in a counterclockwise direction (normal rotation) in FIG. 11, such that the piston 155 travels in the compression direction by the number of steps being set.

Subsequently, the stepping motor 110 rotates such that the piston 155 moves by the same number of strokes in the opposite direction, that is, the clockwise direction in FIG. 11 so that the piston 155 returns to the home position.

As described above, with reciprocal movement of the piston 155, the air supply operation including air compression, air supply, and air induction is performed.

Figure 15:
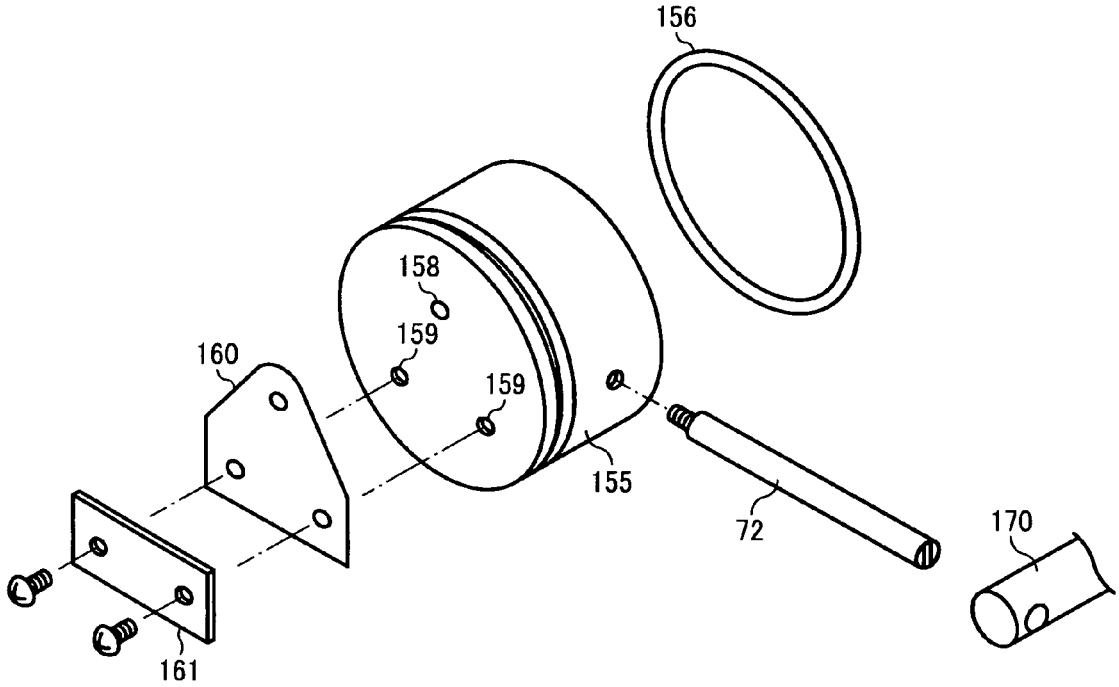
FIG. 15 is a partially enlarged view of a front-end portion of a piston according to an illustrative embodiment of the present invention.

Referring now to FIG. 15, there is provided a partially enlarged view of the tip portion of the piston 155. As illustrated in FIG. 15, the piston 155 includes an air inlet 158 on the front end surface thereof. The air inlet 158 communicates the inside and the outside of the piston 155.

In order to close the inlet 158, a substantially triangular leaf valve 160 is fixed to the front end surface of the piston 155 through a holding member 161. A plurality of screw holes 159 is provided on the front end surface of the piston 155.

Initially, the leaf valve 160 closely contacts the front end surface of the piston 155, thereby closing the inlet 158. The leaf valve 160 is formed of flexible polyester film or stainless steel, for example, so that when being pressed, the leaf valve 160 returns to is original shape. The thickness thereof is approximately 0.05 to 0.2 mm.

When the piston 155 travels in the compression direction (in the direction to the left in FIG. 11), the leaf valve 160 closely contacts the front end surface of the piston 155, closing the inlet 158, thereby preventing air from leaking inside the piston 155.

By contrast, when the piston 155 travels in the expansion direction (in the direction to the right in FIG. 11), the leaf valve 160 is pushed open, thereby drawing air from the piston 155 to inside the cylinder 153.

As described above, associated with movement of the piston, air is drawn inside the cylinder.

The leaf valve 160 is provided to the front end surface of the piston 155. Alternatively, the valve is provided to the cylinder 153, for example, to the end surface of the cylinder head.

If air does not accumulate in the cylinder 153 as the piston 155 travels in the compression direction, that is, if air is injected as the piston 155 travels, a high air ejection pressure is not achieved, thus making it impossible to eject air with high pressure.

In view of this, according to the illustrative embodiment, as illustrated in FIG. 13, a tabular portion 140 is provided to an air outlet 141 of the cylinder 153. The tabular portion 140 serves as a sealing member and opens/closes the air outlet 141 at a predetermined timing. That is, the tabular portion 140 remains closed until a predetermined time comes, thereby increasing the air ejection pressure and thus enabling the air to be ejected under high pressure.

As illustrated in FIG. 13, the boss 143 provided with the air outlet 141 includes a through-hole 144 perpendicular to the air outlet 141. According to the illustrative embodiment, the through-hole 144 is circular, and a switching shaft 135 having a cylinder shape is inserted therethrough.

The switching shaft 135 is inserted through and rotatably supported by a shaft bearing 138 and the through-hole 144. The shaft bearing 138 is fitted into a protrusion 137 provided to the side surface of the air supply device 1000 in a protruding manner.

An E-type retaining ring is provided to one end of the switching shaft 135, that is, the bottom end portion thereof. At the other end of the switching shaft 135, a disk 134 and a cylinder portion 134a are fixed. With this configuration, the switching shaft 135 is positioned in the shaft direction and prevented from falling off.

The switching shaft 135 includes the tabular portion 140 at a position corresponding to the air outlet 141. The tabular portion 140 is formed such that a portion of the switching shaft 135 is cutout and flattened. According to the illustrative embodiment, both sides of the switching shaft 135 are cutout in the same shape, and the flat surface (tabular portion) is positioned in the shaft center.

When the tabular portion 140 is oriented in the vertical direction as illustrated in FIG. 13, the tabular portion 140 blocks the air outlet 141, thereby preventing air in the cylinder 153 from being injected from the air outlet 141.

By contrast, when the tabular portion 140 rotates by 90 degrees, facing in the horizontal direction, the air outlet 141 is opened, thereby allowing air inside the cylinder 153 to be injected from the air outlet 141 passing both sides of the tabular portion 140, or the tabular portion.

According to the illustrative embodiment, when the switching shaft 135 is rotated by 90 degrees, the direction of the tabular portion 140 is switched between the vertical direction and horizontal direction, thereby opening and closing the air outlet 141. Furthermore, when the air outlet 141 is opened at the predetermined timing (the air outlet 141 is closed until the predetermined time comes), the air pressure in the cylinder 153 can be increased, thus being able to eject air with high pressure.

Referring now to FIG. 14, there is provided a cross-sectional view of a cam mechanism that drives the air supply device 1000.

As illustrated in FIG. 14, the cam mechanism includes a cam 131, a roller 242, a link lever 241, a shaft 240, a pull spring 157 and so forth.

Figure 16:
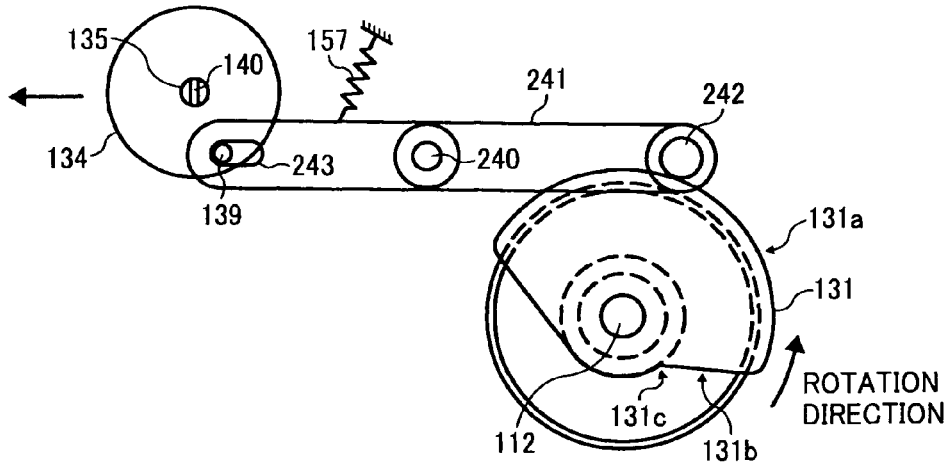
FIG. 16 is a schematic diagram illustrating a cam mechanism when the piston of FIG. 15 is at a home position according to an illustrative embodiment of the present invention.

The cam 131 is fixed substantially at the rear of the drive shaft 112. As illustrated in FIG. 16, the cam 131 has a substantially fan-like shape and includes an arc portion 131*a* and a linear portion 131*b*. It is to be noted that a connecting portion where the arc portion 131*a* and the linear portion 131*b* meet has a substantially round shape ("R-shape") so as to enable the roller 242 (a cam follower), described later, to move smoothly.

As illustrated in FIG. 14, a shaft 240 is fixed on the outer surface of the rear panel 151 and protrudes therefrom. The link lever 241 is pivotally provided to the shaft 240.

As illustrated in FIG. 16, the link lever 241 is a relatively long and narrow plate member with one end thereof pivotally provided with the roller 242 serving as a cam follower. The other end of the link lever 241 includes a slot 243 through which a connecting pin 139 is freely fitted.

The connecting pin 139 is provided substantially on the end surface of the disk 134 fixed to one end of the switching shaft 135 and protrudes therefrom.

A pull spring 157 is provided between the link lever 241 and the device chassis, such that the pull spring 157 urges the link lever 241 so as to press the roller 242 against the peripheral surface of the cam 131.

While the pull spring 157 exerts force, the connecting pin 139 is inserted into the slot 243 of the link lever 241. Because the roller 242 of the link lever 241 contacts the peripheral surface of the cam 131 and the shaft 240 is fixed, the roller 242 moves in accordance with rotation of the cam 131, causing the link lever 241 to swing.

When the link lever 241 swings, the disk 134 rotates by a predetermined amount (degree) through the connecting pin 139.

According to the illustrative embodiment, the cam mechanism described above is configured such that the disk 134 rotates through an arc of approximately 90 degrees.

FIG. 16 illustrates a state in which the piston 155 of the air supply device 1000 is at the home position. When the piston 155 is at the home position, the link lever 241 is substantially horizontal and the connecting pin 139 is positioned at a relatively right bottom end of the disk 134. The tabular portion 140 provided to the switching shaft 135 faces in the vertical direction so as to close the air outlet 141.

When the drive shaft 112 rotates in the counterclockwise direction as indicated by an arrow in FIG. 16, the piston 155 moves in the compression direction. Along with the piston 155 moving in the compression direction, the cam 131 rotates.

Figure 17:
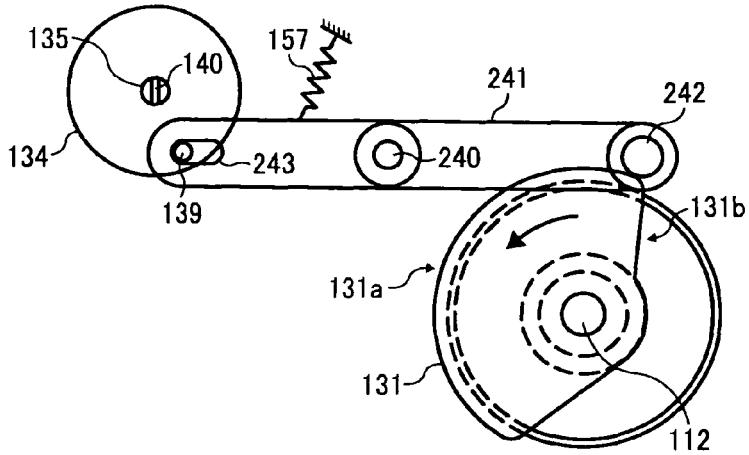
FIG. 17 is a schematic diagram illustrating the cam mechanism when compressing air according to an illustrative embodiment of the present invention.

As long as the arc portion 131*a* contacts the roller 242, that is, until the arc portion 131*a* comes to the position shown in FIG. 17, the position of the roller 242 remain unchanged. Thus, the disk 134 does not rotate, and the air outlet 141 remains closed. Accordingly, as the piston 155 moves, the pressure inside the cylinder 153 increases.

Furthermore, when the cam 131 further rotates from the position shown in FIG. 17, the roller 242 separates from the arc portion 131*a*. In other words, when the roller 242 slidably contacts the linear portion 131*b*, the link lever 241 rotates in the clockwise direction due to the force of the spring 157.

Subsequently, the connecting pin 139 in the slot 243 is pressed, causing the disk 134 to rotate in the counterclockwise direction in FIG. 17. Accordingly, the switching shaft 135 (and the tabular portion 140) rotates, thereby opening the air outlet 141 as illustrated in FIG. 18.

The rotation angle of the cam 131, that is, the degree to which the roller 242 separates from the arc portion 131*a* and travels to an inner end portion 131*c* of the linear portion 131*b* is very small in terms of traveling distance of the piston 155. Therefore, the air outlet 141 can be opened within a short period of time, releasing the air compressed inside the cylinder 153, thereby enabling the air to be ejected with great force.

According to the illustrative embodiment, the rotation angle of the cam 131 during reciprocal movement of the piston is approximately 126 degrees. When the cam 131 rotates by approximately 92 degrees from the home position as shown in FIG. 16, which is approximately ¾ of the rotation range, the air outlet 141 starts to open. When the cam 131 rotates the remaining approximately 34 degrees, which is approximately ¼ of the rotation range, the air outlet 141 completely opens.

Figure 18:
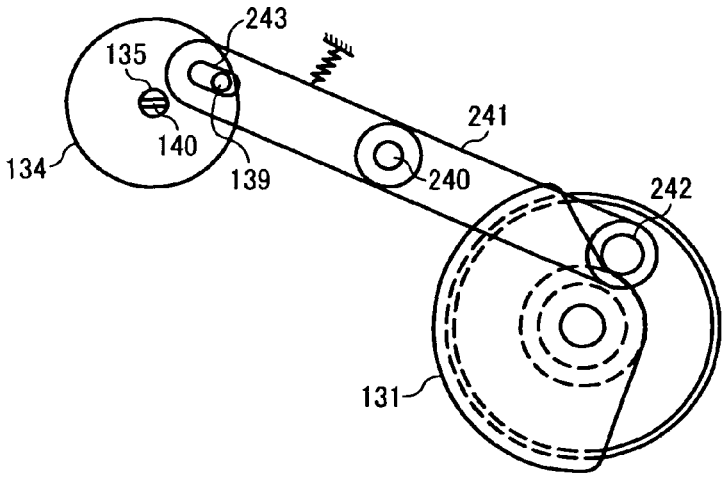
FIG. 18 is a schematic diagram illustrating the cam mechanism immediately after the compressed air is injected according to an illustrative embodiment of the present invention.

Referring now to FIG. 18, there is provided a schematic diagram illustrating the cam mechanism when the piston 155 is at the maximum compression position (top dead center).

The cam 131 does not rotate any further from this position in the counterclockwise direction. While the piston 155 travels from the maximum compression position to the home position, the cam 131 rotates in the clockwise direction, that is, in the direction opposite the compression direction.

When the cam 131 rotates in the opposite direction, the roller 242 is pushed up by the linear portion 131*b* of the cam 131, causing the link lever 241 to rotate in the counterclockwise direction in FIG. 18. Accordingly, the disk 134 rotates in the clockwise direction, thereby closing the air outlet.

After the air outlet 141 is closed, the air outlet 141 remains closed as long as the arc portion 131*a* slidably moves on the roller 242 (from the position shown in FIG. 17 to the position shown in FIG. 16).

With this configuration according to the illustrative embodiment, the sealing member mechanically connected to the piston is provided to the air outlet, and the air outlet is closed until the predetermined timing during the compression process. The air outlet can be opened in a short time near top dead center, thereby enabling the air pressure to increase and thus ejecting the highly compressed air with great force.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A sheet separator using air, comprising:

a plurality of nozzles, through which compressed air is ejected against a nip portion where a plurality of rotating members meets, presses each other, and carries a sheet of a recording medium therebetween, disposed downstream in a direction of sheet transport and also in a direction of a width of the recording medium; and a guide member to hold and secure the nozzles, the guide member including a conduit to supply the compressed air to the nozzles, and a guide surface to direct the recording medium separated from the nip portion, wherein the nozzles are detachably mountable to the guide member, and wherein a tip of each of the nozzles from which air is ejected projects beyond the leading edge of the guide member on the nip portion side.

2. The sheet separator according to claim 1, wherein the nozzles project beyond a leading edge of the guide member.

3. The sheet separator according to claim 1, wherein the tip of each of the nozzles from which air is ejected is round.

4. The sheet separator according to claim 1, wherein the guide member includes a plurality of notches each of which has an angular shape in cross section to position and fix the nozzles, and the cross section of each of the nozzles corresponds to the cross section of the notches.

5. The sheet separator according to claim 1, wherein each of the nozzles includes at least two surfaces surrounding a nozzle opening through which air is ejected, and the two surfaces direct a flow of air to the tip of each of the nozzles.

6. The sheet separator according to claim 1, wherein the guide member includes an upper plate and a lower plate such that the conduit is divided horizontally into two parts including the top and the bottom.

7. The sheet separator according to claim 6, wherein each of the nozzles includes a tubular portion at a base of the nozzles where the guide member is mounted, and the tubular portion includes an O-ring.

8. A fixing unit for fixing a toner image, comprising:

a rotary heating member to heat and fuse a toner image onto a recording medium;

a rotary pressure member to press against the fixing member; and a sheet separator to separate the recording medium by supplying air, the sheet separator including:

a plurality of nozzles, through which compressed air is ejected against a nip portion where the rotary heating member and the rotary pressure member-meet, press each other, and carry a sheet of a recording medium therebetween, disposed downstream in a direction of sheet transport and in a direction of a width of the recording medium; and a guide member to hold and secure the nozzles, the guide member including a conduit to supply the compressed air to the nozzles, and a guide surface to direct the recording medium separated from the nip portion, wherein the nozzles are detachably mountable to the guide member, and wherein a tip of each of the nozzles from which air is ejected projects beyond the leading edge of the guide member on the nip portion side.

9. An image forming apparatus for forming an image, comprising:

an image bearing member configured to bear an electrostatic latent image on a surface thereof;

a developing device configured to develop the electrostatic latent image formed on the image bearing member using toner to form a toner image;

a fixing unit configured to fix the toner image on the recording medium; and a sheet separator to separate the recording medium by supplying air, the sheet separator including:

a plurality of nozzles, through which compressed air is ejected against a nip portion of the image forming apparatus where a plurality of rotating members meet, press each other, and carry a sheet of a recording medium therebetween, disposed downstream in a direction of sheet transport and in a direction of a width of the recording medium; and a guide member to hold and secure the nozzles, the guide member including a conduit to supply the compressed air to the nozzles, and a guide surface to guide the recording medium separated from the nip portion, wherein the nozzles are detachably mountable to the guide member, and wherein a tip of each of the nozzles from which air is ejected projects beyond the leading edge of the guide member on the nip portion side.

* * * * *